US007766336B2

(12) United States Patent
Katz

(10) Patent No.: US 7,766,336 B2
(45) Date of Patent: Aug. 3, 2010

(54) GAME SET

(76) Inventor: Daniel Katz, c/o Schweitzer Cornman Gross & Bondell LLP, 292 Madison Ave.-19th Floor, New York, NY (US) 10017

( * ) Notice: Subject to any disclaimer, the term of this patent is extended or adjusted under 35 U.S.C. 154(b) by 0 days.

(21) Appl. No.: 11/863,360

(22) Filed: Sep. 28, 2007

(65) Prior Publication Data

US 2009/0085291 A1 Apr. 2, 2009

(51) Int. Cl.
*A63F 3/00* (2006.01)

(52) U.S. Cl. ..... 273/287; 273/260; 273/288

(58) Field of Classification Search ..... 273/260, 273/261, 281, 282.1, 282.2, 282.3, 287, 288, 273/255

See application file for complete search history.

(56) References Cited

U.S. PATENT DOCUMENTS

| | | | | | |
|---|---|---|---|---|---|
| 413,026 | A | * | 10/1889 | Catlin | 273/282.1 |
| 783,293 | A | | 2/1905 | Livesey | |
| 1,085,941 | A | * | 2/1914 | Russell | 273/281 |
| 1,404,599 | A | * | 1/1922 | Frederick | 273/244 |
| 1,532,070 | A | * | 3/1925 | Oxhandler | 206/521.7 |
| 1,535,503 | A | * | 4/1925 | Spaeder | 273/285 |
| 1,700,016 | A | * | 1/1929 | Belanger | 273/289 |
| 2,091,555 | A | | 8/1937 | Messinger | |
| 3,169,769 | A | | 2/1965 | Cornish | |
| 3,339,289 | A | * | 9/1967 | Arkin | 434/128 |
| 3,407,758 | A | * | 10/1968 | Simkins | 108/51.3 |
| 3,907,302 | A | | 9/1975 | Butler | |
| 4,055,345 | A | * | 10/1977 | Havlik | 273/282.1 |
| 4,131,283 | A | * | 12/1978 | Havlik | 273/282.1 |
| 4,314,703 | A | | 2/1982 | Grottola | |
| 4,526,550 | A | | 7/1985 | Lurito | |
| 5,505,455 | A | * | 4/1996 | Kamrath et al. | 273/248 |
| 5,540,443 | A | * | 7/1996 | Ballan et al. | 273/285 |
| 6,099,318 | A | | 8/2000 | McLeod et al. | |
| 6,854,730 | B2 | | 2/2005 | Braun | |
| 6,991,232 | B1 | | 1/2006 | Yufa | |

* cited by examiner

*Primary Examiner*—Vishu K. Mendiratta
(74) *Attorney, Agent, or Firm*—Ladas & Parry

(57) ABSTRACT

A portable game set comprising a game board constructed out of corrugated paper board having indicia thereon representing a game board and having slits on each position for receiving a game piece. The game pieces are rectangular and made of a transparent material so that the indicia indicating the game pieces is visible on both sides of the board. The corrugated paper board applies a large amount of pressure on the portion of the game pieces and has a highly frictional surface to securely retain the game pieces within the slits. The corrugated paper board rigidly holds the game pieces in the slits allowing the game to be played during a windy day or in turbulence. When the game pieces are inserted into the slits the game pieces vertically extend approximately 90 degrees with respect to the board thereby providing an improved appearance.

10 Claims, 3 Drawing Sheets

GAME SET

FIELD OF THE INVENTION

This invention relates to portable game sets for playing chess and other games.

BACKGROUND OF THE INVENTION

Various portable game sets have been developed to allow board games such as chess or checkers to be played when a traditional game set is not available or suitable, such as when traveling. For instance, U.S. Pat. No. 3,907,302 to Butler for a chess set teaches a chess set having a playing board with pockets to receive a tab on the bottom of each playing piece. While the playing board in the Butler chess set retains the chess pieces on the board during standard conditions, this chess set does not rigidly hold the pieces to the board so that the pieces maintain their position during severe weather conditions or when the playing board is turned over. Furthermore, in the Butler device, the pieces are maintained at a 45 degree angle with respect to each square on the playing board which differs from the presentation of a standard chess where the pieces are parallel to the top and bottom edges of the game board. This non-traditional presentation distorts the players' visualization of the pieces on the board.

U.S. Pat. No. 783,293 to Livesey for a Chess or Draught Board and Chess or Draughts Man teaches a foldable game board comprised of a plurality of tubes. The Livesey chess board is adapted to receive playing pieces in spaces between two adjacent tubes and through a slit in the top cover. In the Livesey device, the chess pieces are securely held by the adjacent sides of the two tubes. However, the construction of the game board is complicated and is relatively expensive to manufacture. Furthermore, the tube width makes the board bulky when in use and less desirable for use as a portable game set. Additionally, the board will not effectively retain the game pieces if one or more tubes are damaged.

Accordingly, it is desired to have a portable game set that rigidly holds game pieces in perpendicular fashion and is lightweight and economical to manufacture. Furthermore, it is desired to have a portable game board with improved visual display of the game pieces.

Accordingly, it is an object of the present invention to provide a portable game set that rigidly holds a plurality of game pieces on the game board.

Yet another object of the present invention is to provide a portable game set that rigidly holds a plurality of game pieces on the game board and is lightweight.

It is another object of the present invention to provide a portable game set that rigidly holds a plurality of game pieces on the game board that is economical to manufacture.

A further object of the present invention is to provide a travel game set with improved presentation of the game pieces on the game board.

SUMMARY OF THE INVENTION

The set is comprised of a planar game board constructed out of corrugated paper board and a plurality of game pieces. The game board has indicia thereon in the form of a grid or "checkerboard" pattern of alternating light and dark squares representing positions for the game board. The plurality of game pieces include indicia on their surfaces representing a specific game piece. The game pieces are constructed out of a transparent material so that the indicia is visible to players on opposite sides of the board. The indicia is shaded to provide a three-dimensional appearance. The game board and game pieces are lightweight for improved portability.

Each square on the game board has a slit for receiving and engaging a bottom portion of a game piece. When the game pieces are inserted into the slits, the game pieces are positioned vertically (approximately 90 degrees) with respect to the planar board. This orientation resembles the appearance of a traditional three-dimensional chess pieces positioned on traditional chess boards and allows the players on both sides of the board to easily visualize the chess pieces and their potential movements along the board.

When the game pieces are inserted into the slits, the severed fluting of the corrugated paper board which forms the boundaries or edges of the slit applies pressure on the game pieces and the pieces are securely retained in the slit. The severed fluting on the edges of the slit also forms opposed frictional surfaces which grip the game pieces within the slit and restrict their movement. The force applied by the game board on the pieces of the chess set maintain the pieces in the slits on the board when the board is inverted or subject to a significant degree of force. Therefore, the game set allows the users to play the game in windy or turbulent conditions. Additionally, the board can be stored in an inverted or 180 degree position when in the middle of a game and the position of the pieces will be maintained on the board. Furthermore, corrugated paper board is an inexpensive material and the slits and application of indicia are easily manufactured by conventional machinery. This allows the portable game set to be manufactured economically and efficiently.

DESCRIPTION OF THE DRAWINGS

The foregoing and other objects, features and advantages of the present invention will become apparent from the following description of a preferred embodiment of the invention, taken in conjunction with the accompanying drawings, wherein.

DETAILED DESCRIPTION OF THE PREFERRED EMBODIMENTS

Figure 1:
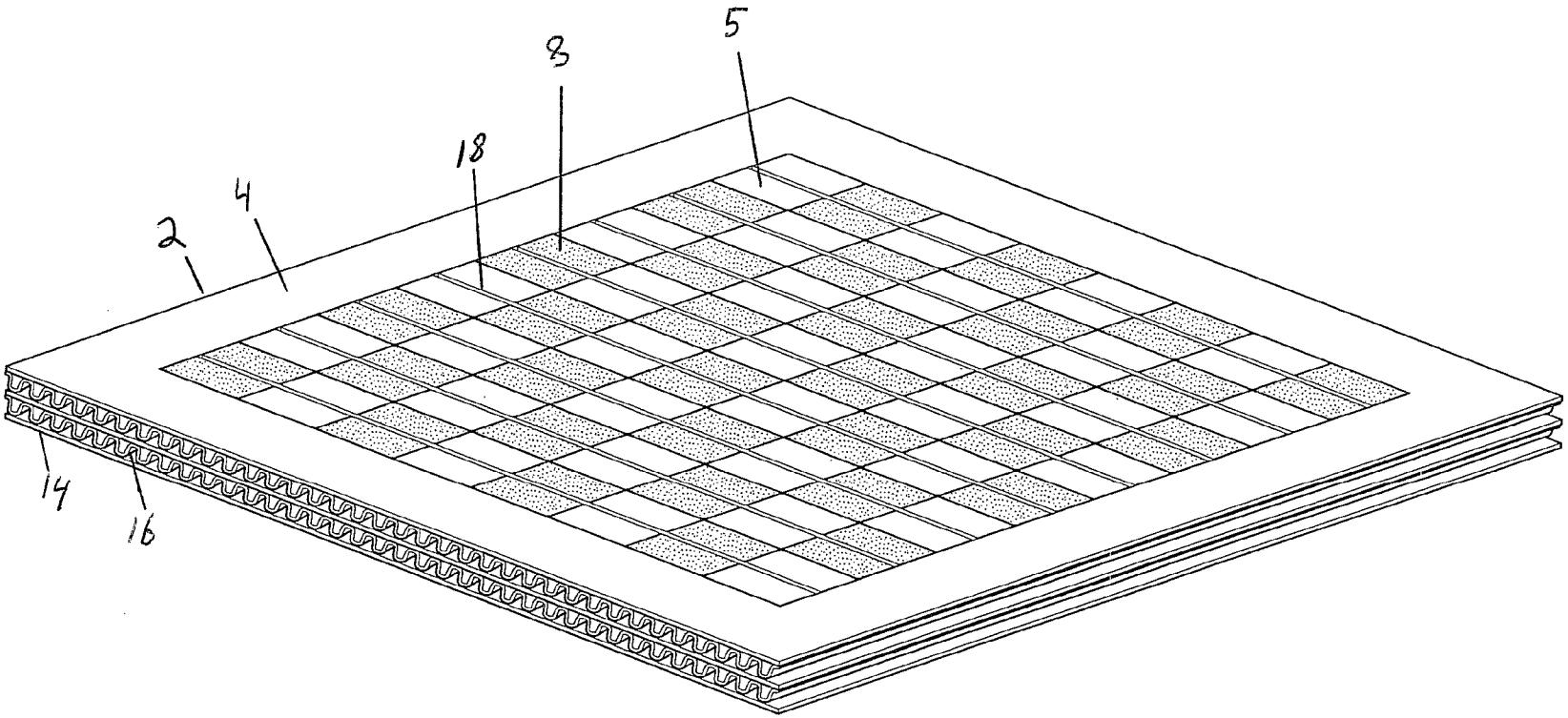
FIG. 1 is a perspective view of the new game board having indicia representing a chess or checkers game board.
Figure 2:
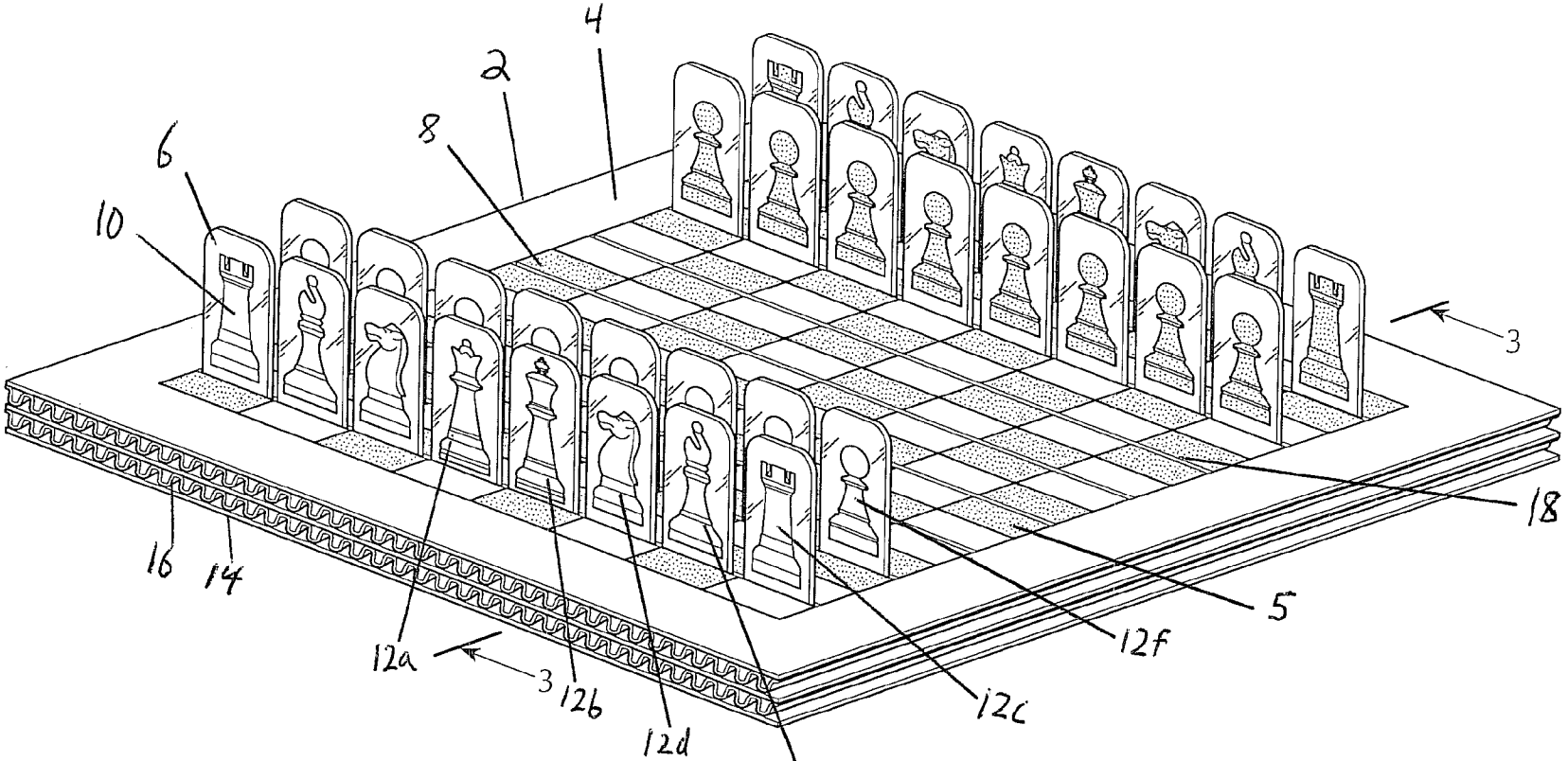
FIG. 2 is a perspective view of the new game board with a plurality of game pieces bearing indicia representing chess pieces.

With reference to FIGS. 1 and 2, the present invention is directed to an improved game set 2 having a game board 4 and a plurality of game pieces 6. The game board 4 is planar and has indicia 8 on its surface representing positions of a game board for a particular game. In the preferred embodiment shown, the game is chess and the game board 4 consists of 64 squares 5 which alternate between being light and dark. This indicia 8 forms a traditional chess board 4. While the game board 4 shown is suitable for chess or checkers, the indicia on the game board 4 and the indicia 10 on the game pieces 6 may be designed for other board games including backgammon, Chinese checkers, go, and the like. Furthermore, one side of the game board 4 may have indicia 8 for multiple games. Alternatively, indicia 8 for playing a different game may be placed on the obverse side of the game board 4.

The game set includes a plurality of game pieces 6 having indicia 10 thereon representing "chessmen" or a type of game piece for the particular game to be played on the board. For instance, in the preferred chess embodiment shown, indicia 10 representing queens 12*a*, kings 12*b*, rooks 12*c*, knights 12*d*, bishops 12*e*, and pawns 12*f* are shown. The indicia 10 on the game pieces may be shaded to give the indicia a three-dimensional appearance. The game pieces are preferably constructed out of a stiff, lightweight and durable material such as plastic. Furthermore, the game pieces 6 are preferably transparent so that the indicia 10 can easily be viewed by players on both sides of the board. Alternatively, indicia 10 may be placed on both sides of the game pieces 6 and the game pieces are made out of a material that is not transparent. In the embodiment shown, the pieces 6 are planar and have a rectangular shape. Alternatively, the pieces 6 may be multi-planar and may have a variety of different shapes.

The game board 4 is fabricated from corrugated paper board which is constructed of one or more flat plies 14 and internal fluting 16. Corrugated paper board is available in a variety of different constructions differing in the strength of the paper, the number of plies 14 and layers of fluting 16, and type of fluting. The novel game board of the invention may be formed from any type of corrugated paper board which has fluting. In the embodiment shown, the corrugated paper board has two layers of fluting 16 and three plies 14. In a preferred embodiment, a high quality corrugated paper board such as a 275 lb board with BC flute is used.

Figure 3:
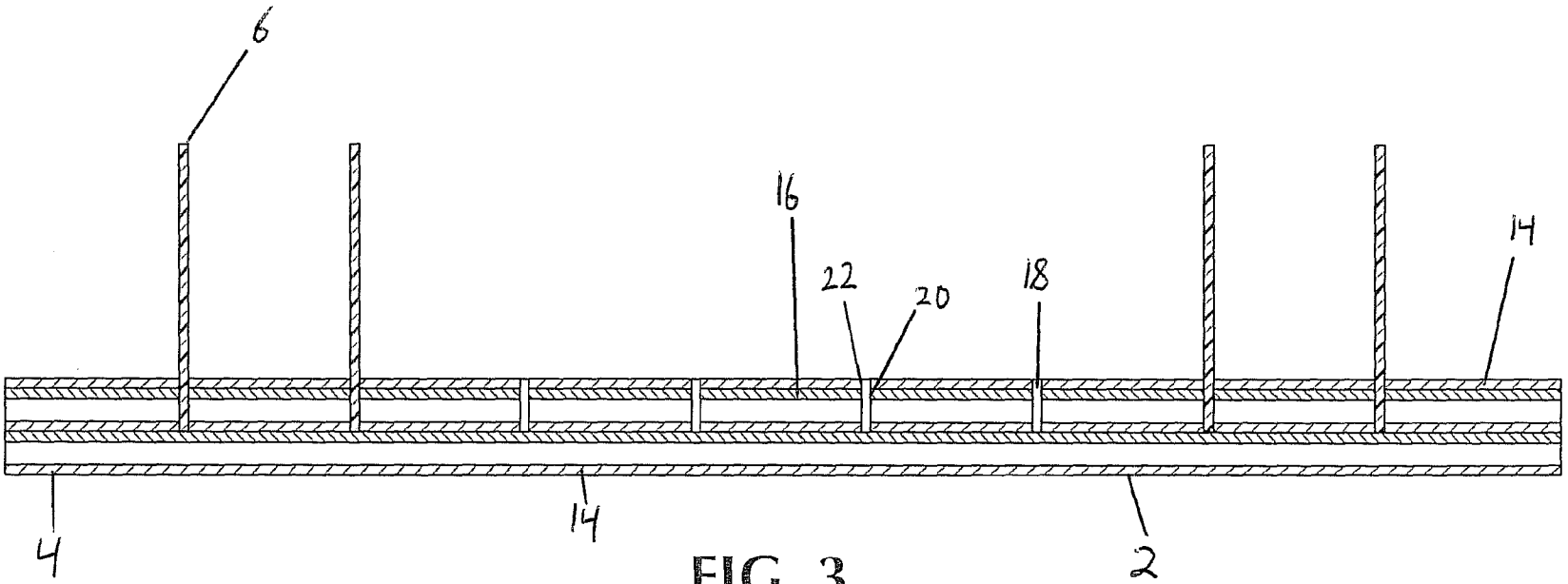
FIG. 3 is a cross-sectional view of the new game board taken along line 3-3 of FIG. 2.

The game board 4 has slits 18 running through the top ply 14 and through a layer of fluting 16 in the corrugated paper board. The slits 18 are located on each position of the game board 4 for receiving game pieces 6. In the embodiment shown in FIGS. 1-3, the slits 18 comprise a continuous slit on each row extending from the end of the leftmost square to the end of the rightmost square. However, the slits 18 may alternatively comprise discrete slits within each square.

The portion of the game pieces 6 that are received in the slits 18 on the game board 4 must have dimensions to allow the game pieces 6 to be received in the slits 18 in the game board 6. In the embodiment shown, the slits 18 are linear and the game pieces 6 are planar and have a rectangular shape. A small side of the rectangular game pieces 6 is adapted to be inserted into the slits 18. The arrangement of slits 18 shown in FIGS. 1-2 comprising continuous slits on each row allows the slits to span the entire width of each square. Therefore, the game pieces 6 can have dimensions nearly the entire width of a square thereby providing a large space for the indicia to be displayed and a large surface to easily grasp the pieces. When the game pieces 6 are inserted into the slits 18 on the game board 4, the game pieces stand up approximately 90 degrees with respect to the game board.

When the game pieces 6 are inserted into the slits 18, the severed fluting 20 of the corrugated paper board which forms the boundaries or edges of the slit on the corrugated paper board and on or more of the plies 22 applies a large amount of pressure on the portion of the game pieces 6 within the slit 18. Furthermore, the severed edges 20 of the fluting form a frictional surface to grip the game pieces 6. The pressure on the game pieces 6 and the frictional grip of the severed edges 20, 22 of the fluting and plies rigidly retain the game pieces in their position on the game board 4. Therefore, the corrugated paper board forms an extremely efficient board for retaining the game pieces and is lightweight for improved portability.

In order to maximize the retention force of the slits 18, it is preferred that the width of the slits in the game board 4 is slightly narrower than the width of the bottom portion of each game piece 6 to be inserted.

The game set 2 allows the users to play the game in windy or turbulent conditions without concern for the pieces 6 in the slits 18 being dislodged. Additionally, the board 4 can be stored in an inverted or 180 degree position when in the middle of a game and the position of the pieces 6 will be maintained on the board.

The slits 18 are preferably placed parallel to the top of the game board 4 so that the game pieces 6 are maintained parallel with respect to the top and bottom edges of the game board akin to the position of game pieces on a traditional chess set. Alternatively, the slits 18 may be at a different angle and the game pieces 6 are multi-planar so that the top portions of the game pieces are oriented parallel with respect to the top and bottom edges of the game board. The combination of the transparent pieces and the traditional orientation of the game pieces 6 provides the game set 2 with an improved appearance allowing the game pieces 6 and the game board 4 to be easily viewed by the players in a manner akin to a traditional chess set.

While the embodiment shown has indicia for chess on the game board 4 and the game pieces 6, the board and pieces may have indicia and an orientation of the slits 18 suitable for other games, including Chinese checkers, go, backgammon, and checkers.

Furthermore, corrugated paper board is an inexpensive material and the slits 18 and application of indicia are easily performed by machines. This allows the portable chess set to be economical to manufacture while operating very efficiently.

The present invention may also be used to provide a portable play set instead of a board game. For example, the board 4 may have indicia 8 other than a checkerboard representing a certain environment or setting such as different areas of a farm. The play pieces 6 may have indicia 10 representing objects or things that are complimentary in theme to the indicia on the board 4. As an example, if the indicia 8 on the board is that of a farm setting, the indicia 10 on the play pieces may represent farmers and/or animals.

In another contemplated variation, the board 4 may have a predetermined pattern of slits 18 oriented to allow the user to change the placement of the various play pieces 6 to vary the setting or actions. This allows the user to use the play set to act out a specific story or create a series of imaginary events. The playing pieces 6 have a perpendicular orientation with respect to the board 4 when in the slits 18. This provides the playset with an improved presentation as compared with traditional two-dimensional playsets.

What is claimed is:

1. A portable game set comprising:

a two-dimensional planar game board fabricated of corrugated paper board, having at least one planar top ply establishing a playing surface and at least one layer of sinuous fluting having substantial depth in relation to the top ply;

first indicia representing a series of discrete locations for playing a particular game on the playing surface of the game board;

a plurality of selectively insertable and removable planar game pieces having second indicia thereon;

a plurality of narrow vertical slits extending through the top ply and into a layer of fluting of the corrugated paper game board, whereby opposed severed fluting edges establish multiple game piece gripping regions, said game piece gripping regions adapted to engage and receive game pieces and maintain them in a generally perpendicular orientation with respect to the playing surface of the game board;

said game pieces each having a foot portion having a length and width permitting tight engagement within said narrow slits whereby the game pieces may be securely retained in said slits by the application of pressure and friction on the foot portions of the game pieces within the slits by the opposed severed fluting edges of the corrugated paper board which form the boundaries of said slits.

2. The portable game set as set forth in claim 1 wherein said slits are continuous and extend across each row on the game board.

3. The portable game set as set forth in claim 1 wherein said slits comprise discrete slits disposed in each position on the game board.

4. The portable game set as set forth in claim 1, wherein said game pieces are rectangular.

5. The portable game set as set forth in claim 1, wherein said game pieces are transparent whereby the indicia thereon are visible therethrough.

6. The portable game set as set forth in claim 1 wherein said game board indicia includes a chess grid and the game pieces indicia are chessmen.

7. The portable game set as set forth in claim 1 wherein said game board includes checkerboard indicia and the game pieces indicia are checkers.

8. A game board for playing a game, said game board being constructed of corrugated paper board, said game board having slits therein for securely receiving lower foot portions of associated planar game pieces.

9. The portable game board as set forth in claim 1 wherein said slits have a width that is less than the width of said foot portion of said planar game pieces.

10. The portable game board as set forth in claim 1 wherein said two-dimensional planar game board fabricated of corrugated paper board includes a bottom ply.

* * * * *